US005466206A

United States Patent [19]

Fleming

[11] Patent Number: 5,466,206

[45] Date of Patent: Nov. 14, 1995

[54] EXERCISE AIDS

[76] Inventor: John P. Fleming, 142 Packard Way, Brockton, Mass. 02401

[21] Appl. No.: 236,484

[22] Filed: Apr. 29, 1994

[51] Int. Cl.[6] ..... A63B 26/00

[52] U.S. Cl. ..... 482/141; 482/91; 482/148

[58] Field of Search ..... 15/234.4, 234.5, 15/234.6, 234.8; 248/148, 51, 52, 49; 482/141, 91, 25, 148

[56] References Cited

U.S. PATENT DOCUMENTS 3,686,703 8/1972 Ray ..... 15/235.4
4,768,778 9/1988 Thomas, Jr. .
5,181,897 1/1993 Agan .
5,205,802 4/1993 Swisher .

FOREIGN PATENT DOCUMENTS 383394 1/1908 France ..... 15/235.4

*Primary Examiner*—Richard J. Apley
*Assistant Examiner*—Jerome Donnelly
*Attorney, Agent, or Firm*—Donald Brown

[57] ABSTRACT

Exercise aids for doing inclined pushups which may be positioned on the top of an elevated surface e.g. a table top. The handle bar of each aid is held in one hand and the person plants the bottom of the feet on the floor and does the pushup. The aid has a handle bar which is inclined at an angle of about 30°±5° with respect to the bottom surface of the aid which supports it to permit back and forth push up type motion.

4 Claims, 1 Drawing Sheet

EXERCISE AIDS

BACKGROUND OF THE INVENTION

This invention relates to exercise aids and more particularly to a new and improved device to permit one to perform pushups without the traditional penalties of the floor pushup.

In particular the use of this device permits one to do pushups without the imposition of over stress to the wrist joint.

BRIEF DESCRIPTION OF THE INVENTION

The present invention relates to exercise aids which allow one to more readily do inclined pushups.

The device is positionable on top of a support such as on top of any flat surface, e.g. a kitchen table, desk top, bench, staircases and chairs etc. The aid includes a non skid surface on the bottom thereof that also protects the surface it may be placed upon and provides the immobile stability needed to do an inclined pushup.

The aid preferably comprises a pair of devices which comprise an inclined bar member supported by a means having flat bottom surface, the inclined bar member being at an angle of about 30°±5° to the flat bottom surface of the aid to which it is coupled. The flat surface comprises a slip resistant surface e.g. of rubber (natural or synthetic). The inclined member preferably is round in diameter (cross section) and is most preferably tubular.

An inclined push up using the invention is one in which the person has his or her feet on the floor, as if standing in an upright position, and inclines to support their weight on the exercise aids by use of their hands with the arms fully extended.

The person then bends their arms to move their body towards the support aids of this invention and then returns back to their original position with their arms extended.

Another device for doing inclined pushups known in the art is shown in U.S. Pat. No. 5,181,897. In this device the device is hung over the side of an object such as a table and uses substantially a right angle bottom support member.

DETAILED DESCRIPTION OF THE INVENTION

Reference should now be had to FIGS. 1 to 6 for a detailed description of the invention.

Figure 1:
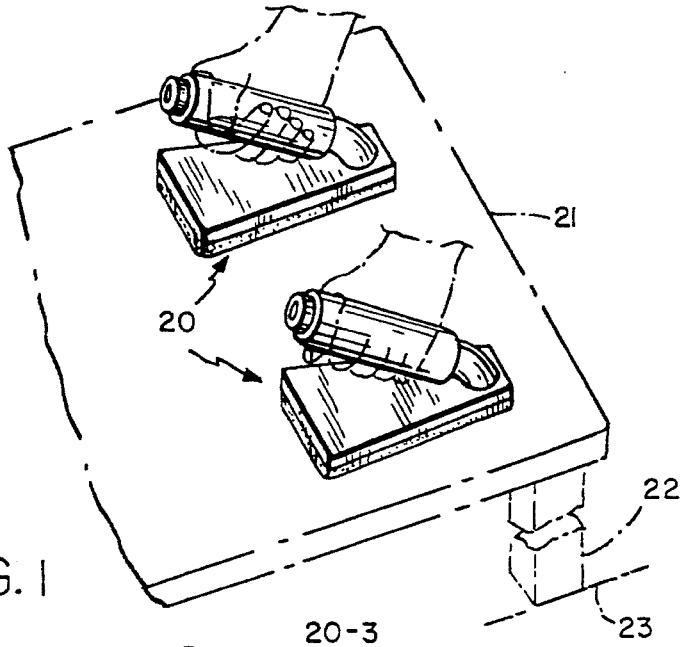
FIG. 1 is a perspective view of the exercise aids of this invention on a support table (dotted)and shows the position of the hand of the user (dotted) when doing inclined pushups.
Figure 2:
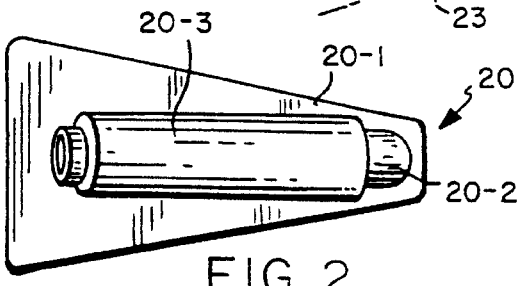
FIG. 2 is a top plan view of one of the aids of this invention.
Figure 4:
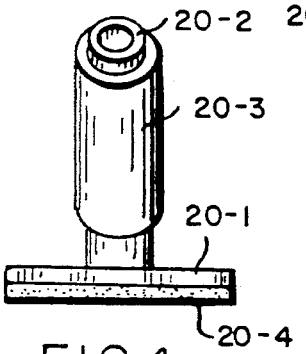
FIG. 4 is a rear view of the device of FIG. 3.
Figure 3:
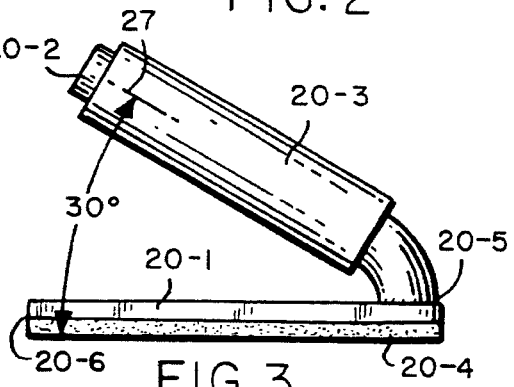
FIG. 3. is a side view of FIG. 2.
Figure 5:
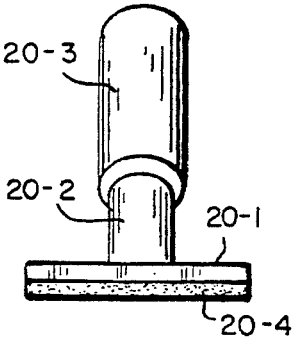
FIG. 5 is a front view of the device of FIG. 4.
Figure 6:
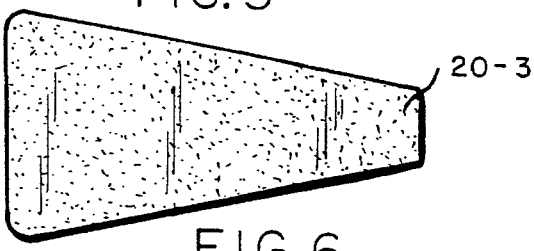
FIG. 6 is a bottom of the device of FIG. 2.

FIG. 1 shows the pair of exercise aids of this invention, each one shown at 20. The exercise aids are shown positioned on a substantially flat surface of e.g. a table 21 having four legs 22 (only one shown) positioned on the floor 23.

Each exercise aid 20 includes a base portion 20-1 e.g. of metal such as aluminum, a handle bar portion 20-2 joined to the base e.g. by welding at 20-5, preferably a grip portion 20-3 e.g. of polyurethene surrounding a portion of the handle bar portion, and a slip resistant portion 20-4 e.g. of a natural or synthetic rubber such as neoprene of 60–70 durometer hardness.

The handle bar is preferably of 1" diameter aluminum tubing however, it is clear that solid materials maybe used or the shape could be configured to have e.g. finger grips or could be rectangular or other cross section so long as it is comfortable to the user.

The angle of the handle 20-2 centerline 27 to the bottom of the aid resting on the surface is about 30°±5° with 30° being the most preferred.

In use, the pair of exercise aids 20 are positioned on e.g. a table 21 top surface with the welded portion 20-5 facing the user (See FIG. 1). The user stands on the floor 23 and holds an exercise aid in each hand (shown dotted). The user then plants his or her feet on the floor 23 about 2' to 3' from the table and proceeds to lower the body towards the table and then back away from the table.

The slip resistant surface 20-4 is preferably connected to the base 20-1 by adhesive 20-6.

I claim:

1. An exercise kit including a pair of exercise aids, each independent of the other, for positioning on a flat surface, each aid comprising a base member having two ends, a slip resistant surface attached to the bottom of the base member, an inclined handle bar having two ends and having a center line and joined at only one end to the base member and unconnected at the other end, said inclined handle bar having a center line being at an angle of about 30°±5° respect to the surface of the aid for positioning on a flat surface, said handle bar extending from near one end of the base member towards said second end of said base member, each of the handle bars terminates substantially near the opposite end of said base member from said connected end add each handle bar having an area for gripping by a user.

2. The exercise aids according to claim 1, each aid includes a gripping surface mounted on each of the bars.

3. The exercise aids according to claim 2 in which each aid slip resistant surface is natural rubber or synthetic rubber.

4. The aid of claim 1 in which said bar is of a round diameter and is hollow.

* * * * *